US005788145A

United States Patent [19]

Grahahm et al.

[11] Patent Number: 5,788,145

[45] Date of Patent: Aug. 4, 1998

[54] FOLDABLE COVERED FOOD CONTAINER

[75] Inventors: Mark S. Grahahm, Sioux Falls; Gregory A. Green, Lennox, both of S. Dak.

[73] Assignee: Bell Paper Box, Inc., Sioux Falls, S. Dak.

[21] Appl. No.: 771,674

[22] Filed: Dec. 23, 1996

[51] Int. Cl.[6] ..... B65D 5/66

[52] U.S. Cl. ..... 229/113; 206/551; 229/115; 229/146

[58] Field of Search ..... 206/551; 229/113–115, 229/141, 145, 146, 148, 149, 154; 220/4.22, 4.23

[56] References Cited

U.S. PATENT DOCUMENTS

| | | | |
|---|---|---|---|
| 2,619,276 | 11/1952 | Gibbons | 229/146 |
| 2,623,684 | 12/1952 | Collura | 229/146 |
| 2,654,526 | 10/1953 | McReary | 229/149 |
| 4,570,845 | 2/1986 | Hall | 229/146 |
| 4,877,178 | 10/1989 | Eisman | 229/114 |
| 4,955,527 | 9/1990 | Blackman et al. | 229/114 |
| 5,037,026 | 8/1991 | Hanko | 229/148 |
| 5,058,803 | 10/1991 | Gulliver | 229/148 |
| 5,188,284 | 2/1993 | Eisman | 229/146 |
| 5,205,476 | 4/1993 | Sorenson | 229/148 |

*Primary Examiner*—Jimmy G. Foster
*Attorney, Agent, or Firm*—J. W. Gipple; Gipple & Hale

[57] ABSTRACT

A covered food container especially adapted to hold a single slice of pizza or the like is described having a polygonal configuration and an integrated cover which folds over and is securely latched to enclose the contents. The covered food container can be formed from a single sheet of material such as cardboard or styrene foam and has the advantage that the top and base trays forming the container are interchangeable.

6 Claims, 5 Drawing Sheets

FOLDABLE COVERED FOOD CONTAINER

SUMMARY OF THE INVENTION

The present invention is directed to a unitary, integrated container including a secured, closable cover which is particularly adapted for holding prepared food items such as single slices of pies, pizza, or the like. The invention further involves a simplified container which may be formed from a single sheet of material and which comprises a pair of trays, one of which can be folded over the other to interlock with and form a secure cover.

BACKGROUND OF THE INVENTION

The continuing popularity and demand for ready to eat food items which requires specific types of containers both for safely holding the food item and also for keeping it in a hygenic, yet warm and ready to eat condition has led to the development of a large number of new and unique packaging devices. These devices have, however, frequently been expensive and often complex to fabricate and assemble. Further, certain specific types of food clearly require types of packaging which have not always been available and many of the devices of the prior art have not provided secure closures to prevent accidental opening of the container.

For example, while a number of suitable containers have been developed for packaging cooked, ready to eat, whole pizzas, there is still a need for a suitable covered container which can securely hold a single slice of pizza or other similarly configured food. Such a container clearly should have essentially the configuration of the pizza slice in order to avoid having the slice of pizza slide around within the container and be able to keep the enclosed food hot. Further, this container should be capable of being securely closed to avoid accidental opening and to prevent loss of heat and to prevent airborne contamination. Additionally, it would be desirable for the container to be of simple, unitary construction that does not involve separate bottom and top portions or complex mechanisms for retaining the top and bottom together in closed relationship around the pizza slice.

The present invention, which is specifically configured to hold a slice of food such as a single slice of pizza, provides the above noted advantages while at the same time avoiding problems which have been associated with containers for prepared foods of this type in the past.

DETAILED DESCRIPTION OF THE DRAWINGS

DETAILED DESCRIPTION OF THE INVENTION

Figure 1:
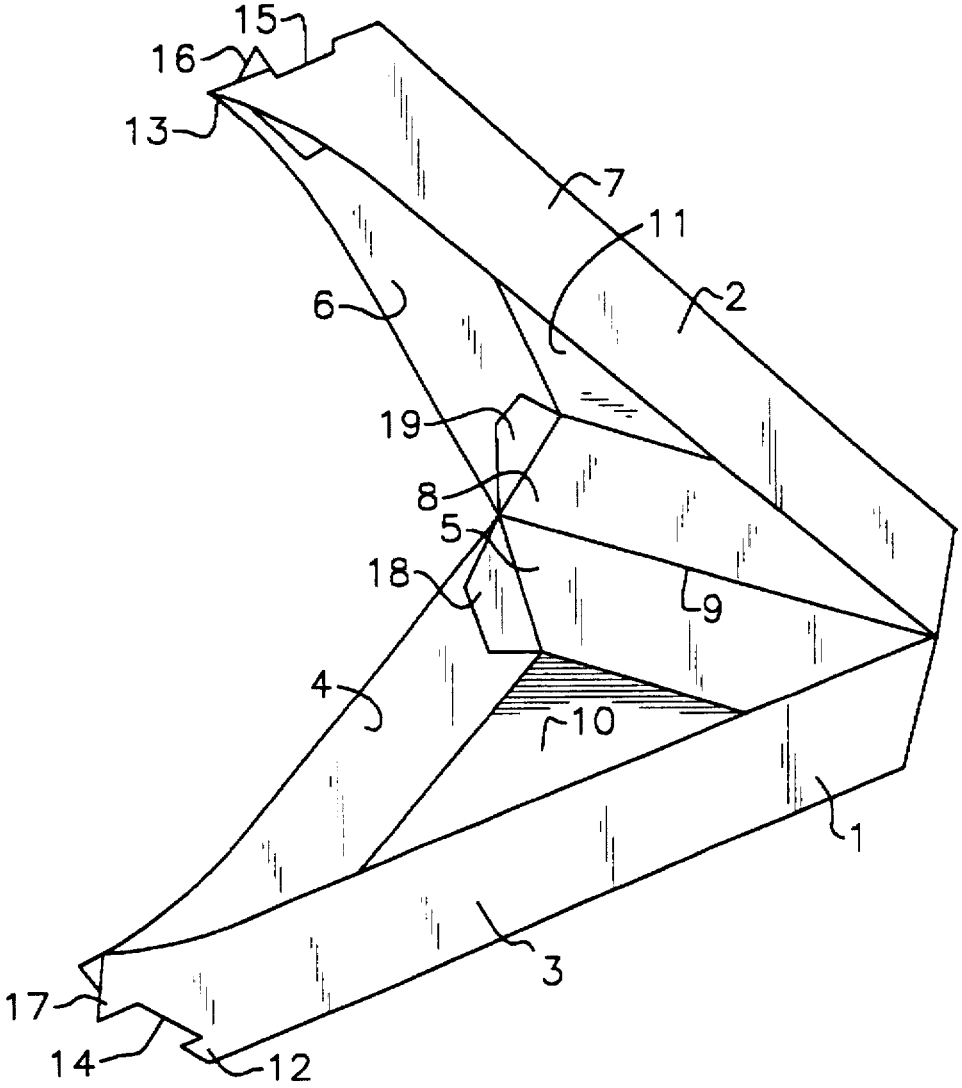
FIG. 1 is perspective view of a triangular tray and cover of the present invention in open configuration ready to receive the intended contents.

In accordance with present invention, a lockable, closeable container, especially adapted for holding a portion of food such as a slice of pizza, is provided comprising two substantially identical polygonal trays, each having a flat multi-sided base and a plurality of respective intersecting side walls. Each of the intersecting side walls extends vertically from one of the sides of the multi-sided base. A single side wall of each of the trays is joined to the other by a fold line which extends the length of the side wall to form a hinge connecting the two trays together such that one of the trays forms a substantially coextensive cover over the other tray. The point or points of intersection between the remaining side walls of each tray are each provided with an interlock remotely opposed to the hinge which connects that tray with the other tray. These interlocks comprise a vertical slot and a horizontally projecting latch such that the latch of one tray engages with the corresponding slot of the other tray when one of the trays is folded over the other to form a cover. These latches hold the respective trays together in a closed secure relationship. Where the polygonal trays making up the closeable container of the invention are triangular, there will of course be only a single latch for each tray. Where the polygonal trays are rectangular in configuration, there will be two latches at the two points of intersection of the side walls of each tray remote from and opposing the hinge which connects the two trays together.

It will also be appreciated in this regard that either tray can form the bottom tray or the top cover and be folded within the other so that the respective latches interlock together.

Although various materials can be employed for construction of the food tray of the present invention, a typical material which has proven to be quite satisfactory is a flexible single sheet of cardboard. Flexible sheets of polystyrene foam can also be used. It will further be appreciated in this regard, that, unlike some food receptacles commonly available, the present invention can be fabricated out of a single sheet of material with appropriate folds and cuts being made to form the container of the invention. As illustrated in the drawings, the vertical side members of each tray are, for example, folded extensions of the material forming the respective bases of the trays.

The unique closable container of the invention will however be more fully appreciated and understood by having reference to the drawings which describe a preferred embodiment thereof.

Figure 2:
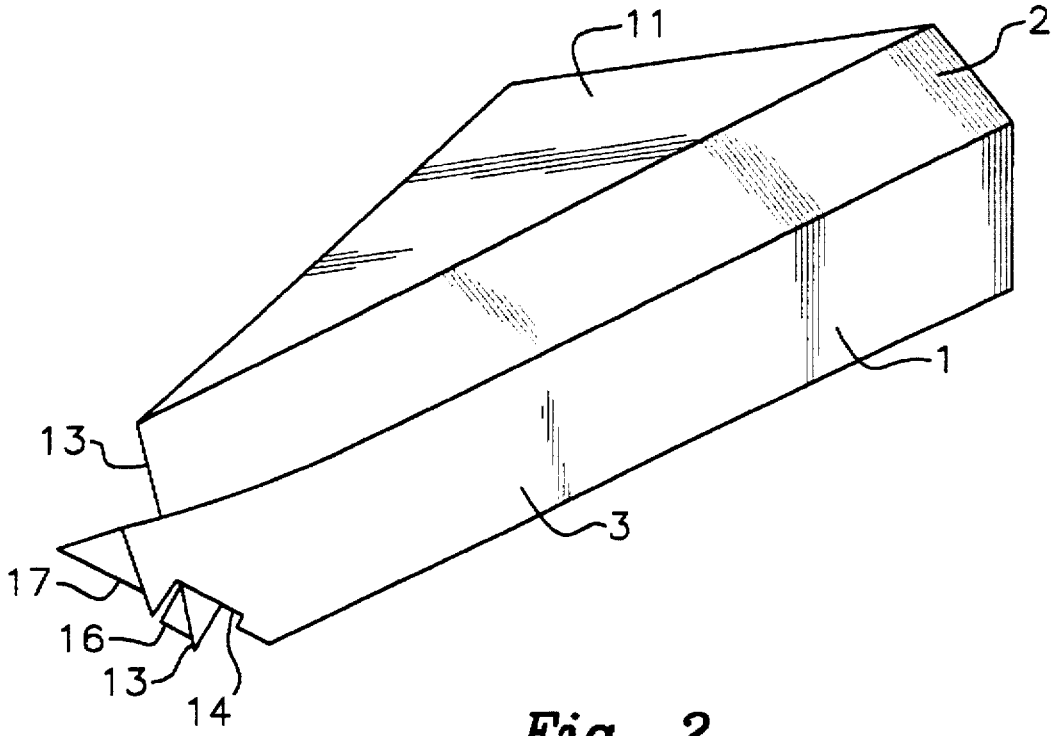
FIG. 2 is a perspective view of the container of FIG. 1 showing the upper tray closed and in engagement with the lower tray to provide a fully enclosed container.

Directing attention to FIG. 1 of the drawings, two triangular trays 1 and 2 are hinged together by fold line 9 and formed of a single sheet of continuous flexible material such as cardboard. As already noted, although the trays illustrated in FIGS. 1 and 2 of the drawings show a bottom tray 1 and a top cover tray 2, it is a feature of the present invention that in fact the device can be inverted the tray 2 is on the bottom and tray 1 on the top with exactly the same result being obtained and the same function achieved.

Bottom tray 1 has a triangular base 10 which is completely surrounded by vertical sides 3, 4 and 5. The two vertical sides 3 and 4 converge at intersection 12 and are joined at their respective other ends to the ends of side 5 to form a complete enclosure around the perimeter of base 10. Joined to side member 5 by fold line 9 is an identical side member 8 on upper tray 2 which is otherwise formed from side members 6 and 7 and base 11. As with tray 1, the two side members 6 and 7 of tray 2 converge at intersection 13. The dimensions of the two trays 1 and 2 can be identical although the present invention does not preclude that one of the trays could be of greater depth than the other. It is however important that the dimensions of the respective bases be essentially the same in order that one tray closely engage and form a cover for the other. At the respective intersecting points 12 and 13 of trays 1 and 2, slots 14 and 15 are provided which completely cut through the material forming the side members. At each intersection there is also provided a horizontally projecting latch 17 and 16 which engages within the slot of the other tray. This feature of the invention can especially be seen in FIG. 2 of the drawings which shows the top tray 2 closed over and partially within bottom tray 1 with the intersection 13 of the upper tray inserted within slot 14 of the lower tray such that latch 16 locks within slot 14 in the lower tray to maintain the respective trays in close closed relationship to one another. Alternatively, owing to the flexibility of the materials used for construction of the two trays as well as the unique latch design of the invention, the lower tray 1 could be fitted within upper tray 2 to reverse the latching of the trays with horizontal latch 17 engaging within slot 15 of the upper tray. Tabs 18 and 19 are provided to facilitate attachment of sides 4 and 5 and 6 and 8 respectively.

Figure 3:
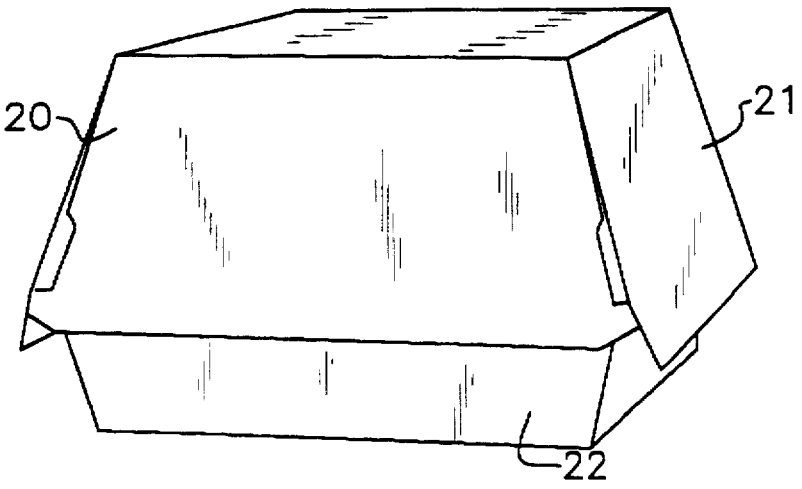
FIG. 3 is a perspective view of a closed, square container and cover of the invention.
Figure 4:
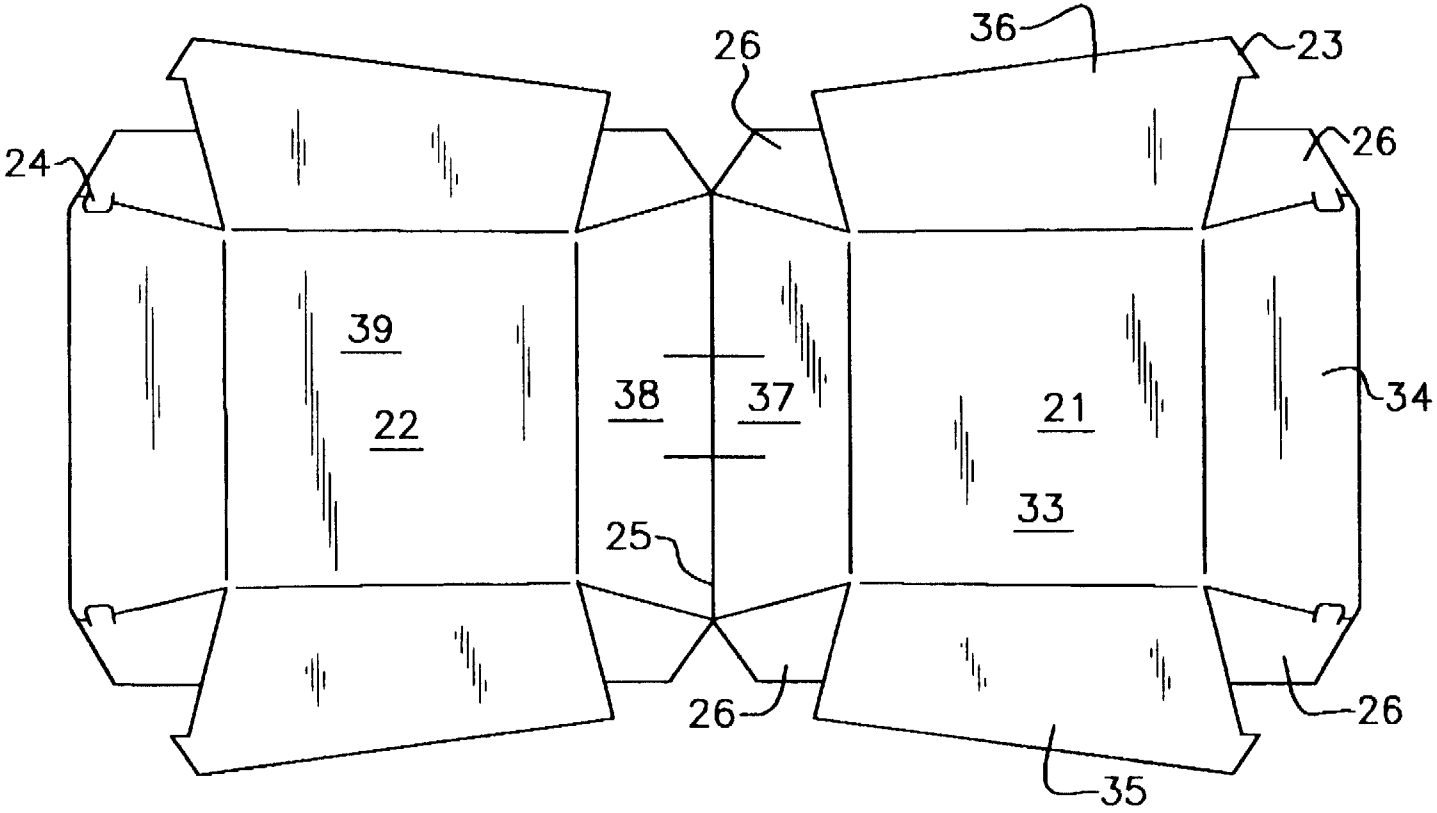
FIG. 4 illustrates the container of FIG. 3 prior to assembly.

Directing attention to FIGS. 3 and 4 of the drawings, the polygonal container of the present invention 20 is shown having a generally configuration and comprising top cover 21 which interlocks with and covers base 22. FIG. 4 illustrates the container of FIG. 3 prior to erection and assembly and shows the unitary sheet of material from which the entire container is constructed. As shown, the two trays, 21 and 22, are joined together by fold line 25 which connects the two side members 37 and 38. Each tray consists of its respective base 33 and 39 and the adjacent for side walls which are erected and joined to form the tray. As illustrated, both trays 21 and 22 are essentially identical both in configuration and size. Tray 21 consists of square base 33 to which are connected the side members 34, 35, 36, and 37. Side members 34 and 37 include tabs 26 which engage with side members 35 and 36 when the tray is erected. Side member 36 is shown with horizontal projecting latch 23 which ultimately engages slot 24 in tray 22 to hold the two trays together in closed relationship. It will be seen that similar slots and latches are provided at the remaining corners of the respective trays 21 and 22 on sides remotely opposing the folded hinge 25.

Figure 5:
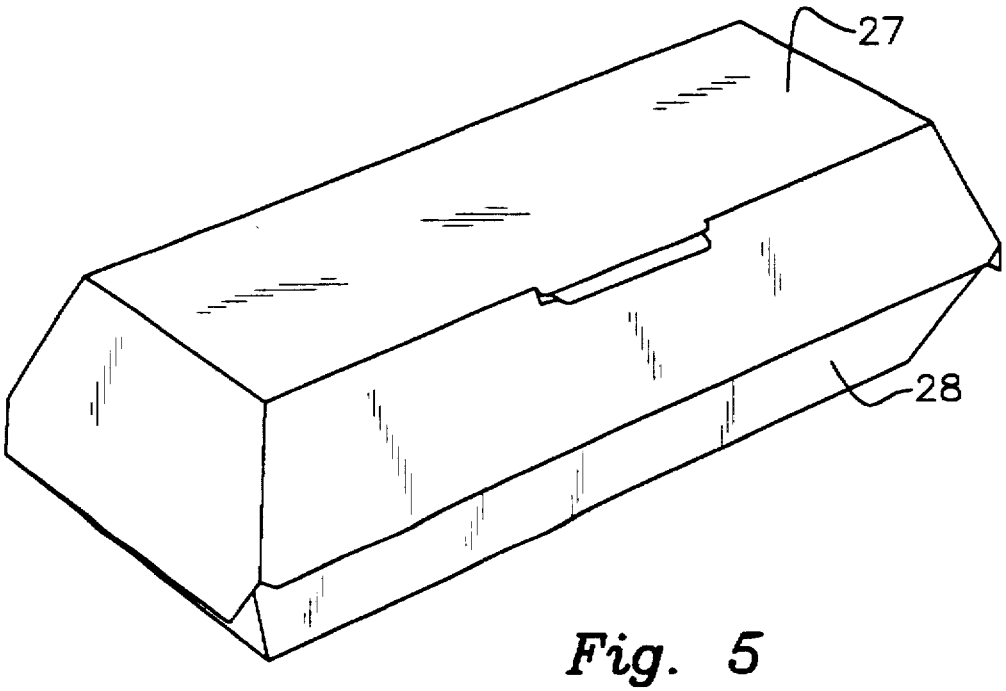
FIG. 5 is a perspective view of a closed, oblong rectangular container of the invention.
Figure 6:
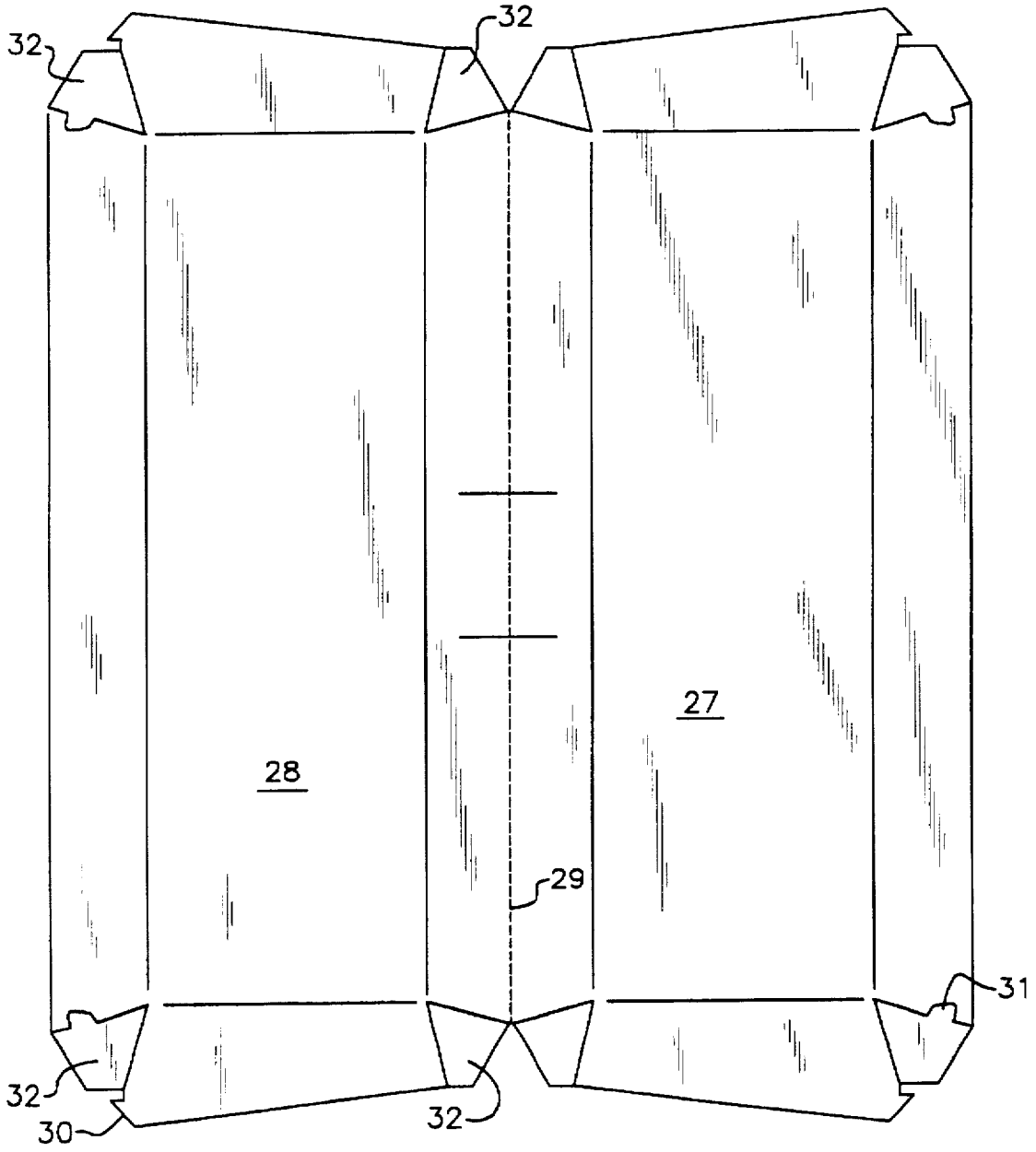
FIG. 6 illustrates the container of FIG. 5 prior to assembly.

FIGS. 5 and 6 of the drawings illustrate the polygonal container of the invention having an oblong rectangular configuration in which top cover 27 interlocks with and forms a cover over base tray 28. FIG. 6 illustrates the container of FIG. 5 in its folded out configuration prior to erection and assembly. It will be seen that except for differences in dimensions the respective component elements of the container of FIGS. 5 and 6 are the same as those of FIGS. 3 and 4. In particular, the two trays 27 and 28 are seen joined by fold line 29. Tabs 32 are shown to facilitate vertical erection of the side wall elements. Latch member 30 extends from the side wall of tray 28 and is adapted to fit within slot 31 of tray 27 to provide an interlock to keep the two trays closed together as illustrated in FIG. 5 of the drawings. A similar feature is found on the other side of the two trays 27 and 28 and provides a similar interlock for the other side of the container.

Forming of the respective trays can otherwise be accomplished in a number of ways from a single piece of material, for example, by providing extended tabs on the side members which can be affixed by glue or other means to the adjoining side members to form the triangular configuration of each tray. Other modifications and expedients will however be apparent to those of ordinary skill in the art and are considered to fall within the scope of the invention as defined by the claims appended hereto.

What is claimed:

1. A lockable, closeable container comprising two substantially identical trays, each having a flat multi-sided base and a plurality of respective, intersecting side walls, each side wall extending vertically from one of the sides of said base; one respective single side wall of each of said trays being joined to the other by a fold line extending the length of said single side wall to form a hinge connecting the two trays together such that one of said trays forms a substantially coextensive cover over the other tray; the respective point or points of intersection between the remaining side walls of each tray being each provided with an interlocking component remotely opposed to said hinge and comprising a vertical slot and horizontally projecting latch member such that the latch member or members of one tray engages with the corresponding slot of the other tray where one tray is folded over the other to hold the respective trays together in closed, secure relationship.

2. The container of claim 1 wherein one of said trays partially folds within the other in said closed relationship to engage said respective latch members and slots with one another.

3. The container of claim 1 which is formed from a single, unitary sheet of semi-flexible material.

4. The container of claim 3 wherein said material is cardboard.

5. The polygonal container of claim 1 wherein each of said trays has a triangular base and three intersecting side walls.

6. The polygonal container of claim 1 wherein each of said trays has a rectangular base and four intersecting side walls.

* * * * *